United States Patent [19]

Winter et al.

[11] Patent Number: 4,641,588

[45] Date of Patent: Feb. 10, 1987

[54] HEAT SHIELD

[75] Inventors: Edward M. Winter, Columbus; David E. Price, Plain City; James E. Hook, Marengo, all of Ohio

[73] Assignee: Columbia Gas System Service Corp., Columbus, Ohio

[21] Appl. No.: 752,658

[22] Filed: Jul. 8, 1985

[51] Int. Cl.[4] ..... F23J 15/00

[52] U.S. Cl. ..... 110/203; 126/307 R

[58] Field of Search ..... 126/307 R, 307 A, 299 C, 126/77; 110/203, 212, 211, 210

[56] References Cited

U.S. PATENT DOCUMENTS

| | | | |
|---|---|---|---|
| 641,992 | 1/1900 | Nussbaum . | |
| 1,280,235 | 10/1918 | Kermode | 126/58 |
| 2,225,166 | 12/1940 | Erby . | |
| 2,650,555 | 9/1953 | Howland et al. . | |
| 2,993,454 | 7/1961 | Hebert | 110/211 |
| 3,552,334 | 1/1971 | Marl et al. . | |
| 3,706,182 | 12/1972 | Sargent . | |
| 4,257,393 | 3/1981 | Liberacki . | |
| 4,373,452 | 2/1983 | Van Dewoestine | 110/210 X |
| 4,479,921 | 10/1984 | Allaire et al. | 110/211 X |

OTHER PUBLICATIONS

"The Corning Catalytic Combustor Design Handbook", date is prior to Sep. 1982.

*Primary Examiner*—Randall L. Green

*Attorney, Agent, or Firm*—Sidney W. Millard

[57] ABSTRACT

A porous shield of silicon carbide is incorporated into the outlet of a furnace for shielding the downstream components from radiation of heat from the furnace and to minimize the heat radiated from the furnace.

12 Claims, 4 Drawing Figures

FIG. 1
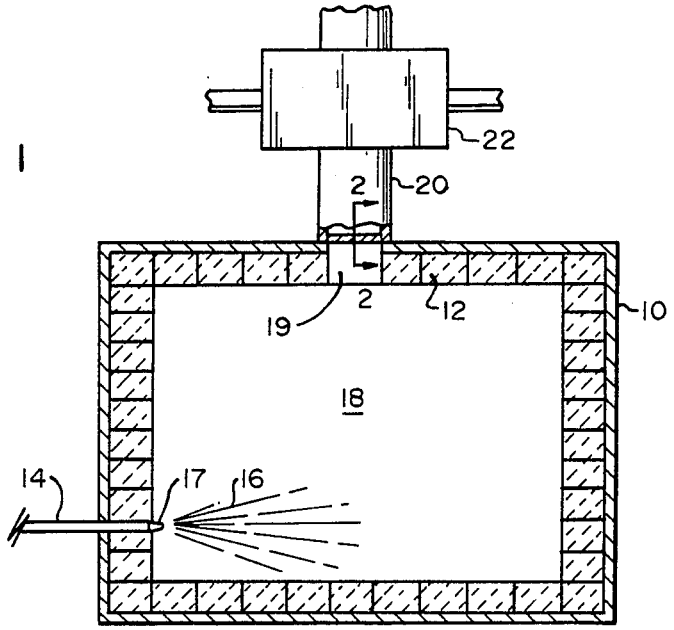
FIG. 2
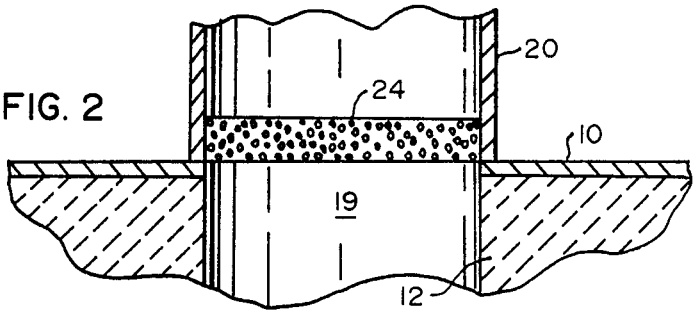
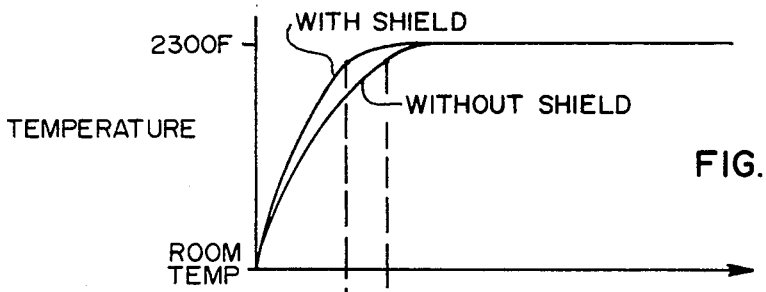
FIG. 3
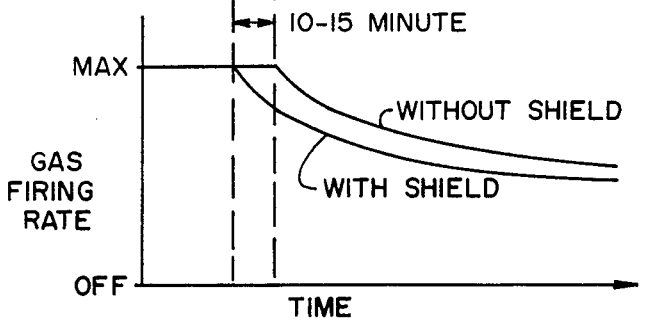
FIG. 4

HEAT SHIELD

FIELD OF THE INVENTION

This invention relates to a heat radiation shield in the outlet of a furnace for purposes of conserving energy and protecting downstream components of the system.

BACKGROUND OF THE INVENTION

For whatever purpose furnaces are used, they have problems of deterioration due to the high temperatures involved and the chemical composition of the combustion products. Furnaces are customarily constructed of steel and have a combustion chamber lining of one or more layers of various kinds of brick, characterized broadly as firebrick. Such bricks are designed primarily to keep the steel walls from direct contact with the flame of the burner and the high heat of the combustion chamber itself. The better the shielding of the steel walls, the longer will be the life span of the basic structure, although the fire brick is replaced on a periodic basis, based on the temperature of the furnace, the useable hours and other factors.

Often there is a flue associated with the outlet from the furnace to receive the combustion products and convey them to an outside environment. In some instances the furnace has no flue and the combustion Products are discharged through a hole in the top of the furnace and products go directly into the air inside the building where the furnace is housed.

Often heat transfer equipment (commonly called recuperators), combustion product treatment apparatus or other equipment is incorporated into the flue where such is used. This equipment is usually placed as close to the furnace outlet as possible in order to increase heat recovery, to conserve space, to reduce the cost of high temperature ducting, etc. As a result, the downstream apparatus in the flue normally receives direct heat radiation from the interior of the furnace.

The heat radiation and the flow of the combustion products along the flue and past the apparatus incorporated into the flue can cause deterioration if care is not exercised. Normally the apparatus in the flue is designed in such a way that deterioration is acceptably slow when the system is operating normally. The flow of the combustion products through the apparatus becomes a means of carrying away the heat radiation. However, there are occasionally periods when the furnace is abruptly stopped, for example, when upsets occur or when production has to be stopped quickly because of emergencies elsewhere in the production line. In these instances, the burners are immediately shut off or turned down to low idle rate, and the flow of combustion products, out the flue and through the apparatus embodied in the flue, is stopped or decreased substantially. Since the furnace interior is still hot, however, heat radiation continues to pass into the flue and continues to heat the apparatus. Without the cooling effect of the flow of combustion products the temperature in the apparatus rises toward the temperature of the furnace. In cases where the heat transfer apparatus in the flue is not designed to handle these higher temperatures, the apparatus can be destroyed or permanently damaged very quickly.

SUMMARY OF THE INVENTION

A solution to the flue equipment deterioration problem is to shield the flue and all downstream components from direct lineal exposure to the interior of the furnace. The shield should be a porous plate mounted in the outlet from the furnace or as near as possible thereto. This will serve two purposes: it will prevent deterioration of downstream components due to heat radiation and it will also decrease the heat loss which results from the radiation of heat outward through the outlet opening to which the flue may be connected. It is also believed that a certain amount of conduction and convection of heat through the outlet is reduced by the installation of a porous plate as a shield, but it is believed that the prime reduction in heat loss is achieved by the reradiation of heat back into the furnace from the shield mounted in the outlet. A plate mounted in the outlet quickly rises in temperature to near the furnace wall temperature, thus most of the radiant heat which would be dissipated to the flue walls without the shield will instead be reradiated to the furnace. The shield is beneficial, therefore, even when no flue duct is present on the furnace because it will decrease heat loss through the combustion products outlet.

The preferred heat shield itself is composed of a reticulated silicon carbide of a very porous nature. The shield itself is most advantageously mounted as close to the furnace outlet as possible, thereby to prevent exposure to the inner flue surfaces to the high heat radiation temperatures.

Objects of the invention will be clear from a detailed reading of the description of the preferred embodiment and an observation of the drawings.

A BRIEF DESCRIPTION OF THE DRAWINGS

FIG. 1 is a diagrammatic perspective view of a furnace including an inlet for a burner, an outlet for combustion products, a flue outlet from the furnace, and equipment mounted in the flue;

FIG. 2 is a fragmentary sectional view taken along line 2—2 of FIG. 1;

FIG. 3 is a chart of temperature vs. time in a furnace with and without the heat shield of this invention; and FIG. 4 is a chart of gas firing rate vs. time in the same furnace as FIG. 3 and again with and without the heat shield of this invention.

DESCRIPTION OF THE PREFERRED EMBODIMENT

It is conventional to form a furnace with a metal shell 10 and with an interior lining of firebrick 12. A feed line 14 delivers a combustible fuel to a burner 16 mounted in an inlet opening 17 to the combustion chamber 18. Oxygen from whatever source is supplied to the burner 16 and the combustible fuel and oxygen burn to generate a flame for purposes of heating the interior of the furnace.

Some furnaces are continually fed materials for heating and some are for batch heating processes. Their function is well known and need not be described here.

Combustion products exit through an outlet 19 to which may be connected a flue 20 which conducts the combustion products first to a recuperator or other apparatus 22 mounted in the flue and subsequently to the atmosphere.

Mounted within the flue at the outlet 19 is a heat shield 24. It is intended that the shield be mounted as close to the outlet opening through the steel shell 10 as possible and preferably at a location whereby radiation from inside the furnace will not be in a direct straight line for heat radiation to any part of the flue 20. It is desired to have the shield mounted such that all of the combustion products must pass through the shield to get to the flue.

The shield itself is a very porous structure comprising reticulated silicon carbide which is formed by the deposition of silicon carbide as a coating on a carbon mesh. The carbon mesh should have about ten to about thirty pores per lineal inch. After deposition of the silicon carbide the carbon base is removed, leaving only the integral silicon carbide material. The shield thus formed may have a thickness of any desired dimension but in the experiments conducted it appears that a shield having a thickness of about one-quarter inch (0.6 cm.) will perform satisfactorily.

The reticulated silicon carbide shield is formed by a process involving high temperature vapor deposition of the silicon carbide on the carbon mesh material. The process of making the shield is not a part of this invention. Flat sheets of the material are purchased from Amercom, Inc., 848 Fullbright Ave., Chatsworth, CA 91311, or from Energy Research and Generation, Lowell 57th Street, Oakland, CA 94608. The desired number of pores per inch must be specified and also the bulk density. The specimens used in these experiments had 20 pores per inch and a bulk density of 14 pounds per cubic foot. Higher density material would be expected to last longer in the combustion environment but will also cost more. Each installation may require a different density material to optimize the cost of using the device.

The sheet is cut or otherwise severed on site to size to provide a plurality of shields 24, each structured especially for a given furnace outlet 19.

The initial experiments conducted included a very small furnace enclosure. With the burner fully on and with no covering over the furnace outlet, the furnace temperature rose to between 1,700° and 1,800° F. During the heating sequence, flames were shooting out of the flue opening a distance of six to eight inches (fifteen to twenty cm.). Then the shield was mounted on the furnace on top of the steel upper surface. The shield was of a thickness of one-quarter inch and the steady state temperature of the furnace rose to a temperature in the range of 1,900° to 2,100° F. with an identical gas-oxygen feed ratio and volume. It is believed that the improved efficiency (inferred from the higher temperature) comes from the reradiation of the energy back into the furnace from the hot shield.

Experiments were conducted with another furnace having a steady state temperature of 2,300° F., 2,400° F. and 2,500° F. (depending upon fuel-oxygen feed rates). The 2,300° F. tests are illustrative; the results from the other steady state temperatures are redundant and will not be reported here.

Initially the furnace is cold and the burners are ignited at their full rated capacity. As the temperature of the furnace increases and comes close to the set point temperature, the controls decrease the firing rate of the burner. Using the same furnace (Furnace A) and burner on different days, from the cold start temperature, it was found that the burners began to cut back about 10 to 15 minutes sooner with the shield in place. This usually takes about one and one-quarter hours with the shield and one and one-half hours without the shield. This is illustrated in FIGS. 3 and 4.

When the shield was tested on an industrial furnace (Furnace B) at 2200° F., the heat-up time was decreased from three hours (without the shield) to two hours and five minutes (with the shield in place).

Obviously, the walls of firebrick do not come to the temperature of the interior of the furnace as quickly as do the combustion gases therein. Heat is transferred to the firebrick by radiation, conduction and convection but the firebrick is effective because it is not a good conductor of heat. Therefore the firing rate will not reach a true, steady state until the temperature gradient through the firebrick and the steel shell is constant. In practice, the gas firing rate keeps dropping off for a few hours until the furnace approaches a steady state temperature. The steady state gas firing rate after five to seven hours of operation is lower with the silicon carbide porous plate in place than without it by a percentage of ten to fifteen percent. This means that less gas is used to heat the furnace to a given temperature and maintain it in that condition with the shield in place. Less gas is used because the gas control valve begins to shut the gas off sooner and in addition, the gas firing rate approaches a lower value with the heat shield in place. The steady state firing rate with the shield in place was measured to be between fifteen and eighteen percent less than the firing rate without the shield in place. The proportions remain about the same at the higher temperatures but the pure magnitude of the amount of gas used would be even greater with the higher temperatures.

In two tests on Furnace A, after eight hours from startup, the steady-state gas firing rate in standard cubic feet per hour was as follows:

| | w/o Shield | With Shield | % Reduction |
|---|---|---|---|
| Test 1 | 113 | 92 | 19 |
| Test 2 | 122 | 103 | 16 |

In a test on the industrial Furnace B the steady state gas firing rate was decreased from 1100 standard cubic feet/hour (without the shield) to 950 standard cubic feet/hour (with the shield in place). The reduction in gas consumption was about fourteen percent. During the experiments, heat shields of one-quarter inch and one-half inch thicknesses were used and in some cases a plurality of shields were mounted in sequence in the outlet area. The one-half inch thickness and the shields in tandem produced only marginally improved results over a single one-quarter inch shield.

The pressure drop across the one-quarter inch shield was measured and the range was found to be from 0.26 to 0.36 inches of water at the beginning of the heating process with maximum firing rate. This compares with a pressure drop across the outlet of 0.05 inches of water without the heat shield in place. At the end of the day, when the furnace had approached steady state and the firing rate was lower, the pressure drop was about 0.07 inches of water with the shield in place and 0.03 inches of water without the shield. Thus, the pressure drop with the shield in place ranges from less than about 0.36 inches to not substantially greater than about 0.07 inches of water.

Weight variation measurements were taken on the shield to see how the weight varied from the time of first exposure to flue gases to the time a steady weight was achieved. The shield lost weight rapidly during the first few days of operation, leveling off after about five days or forty hours of exposure. The shield tested was $5.5 \times 5.5$ inches square and $\frac{1}{2}$ inch thick. It had 20 cells per inch. The temperature of the test was 2600° F. The original weight of the porous plate was 25.68 grams. It was heated for approximately eight hours per day for twenty-one days. After three days or twenty-four operating hours the weight had dropped to 21.51 grams, a loss of 4.17 grams. It is believed that some residue of the carbon base of the plate was slowly burned off. At that point the weight loss was about eighteen percent of the initial weight. After that, the weight began to increase very slightly. After twenty days the weight was 21.99 grams, an increase of 0.48 grams from the minimum after the third day. This weight increase is assumed to be reaction of the silicon carbide with residual oxygen in the combustion flue products. The weight changes of the material did not appear to affect its integrity or strength. The thermal shock at the beginning of the test and subsequently (three months at eight hours per day) was not noticeably different. Although no specific strength tests were measured, the material had adequate strength for the pressure forces involved.

Measurements were taken of the flue gases, both with and without the head shield in place, and there was no substantial change in the combustion gases except for a very small decrease in the nitrous oxide content.

Having thus described the invention in its preferred embodiment, it will be apparent to those skilled in the art that numerous changes and modifications may be made in the instant apparatus without departing from the scope of the invention. Accordingly, the foregoing description is to be construed in an illustrative sense, the scope of the invention being defined solely by the appended claims.

We claim:

1. In the combination with a furnace, a heat radiation shield, the combination comprising, means for forming a furnace, an inlet to said furnace to admit fuel and oxygen, a burner connected to said inlet, said burner being mounted in operable position with the means forming the furnace to promote the combustion of the fuel and oxygen to produce heat and combustion products, an outlet from said furnace, said heat radiation shield being of porous material and mounted in said outlet, said shield and outlet being configured to require that substantially all combustion products exiting said furnace through said outlet pass through the pores of said shield, the shield having the property of passing combustion gases without changing their chemical properties except for reducing the nitrous oxide content, said shield combining its pore size and its thickness to shield the environment beyond the shield from direct heat radiation from inside the furnace.

2. The combination of claim 1 wherein the pore size and thickness of the shield is such that at steady state furnace operation of about 2300° F. the pressure drop across the shield is not substantially greater than about 0.07 inches (0.18 cm.) of water.

3. The combination of claim 2 including a flue means for receiving the combustion gases passing through the shield and delivering said gases to a heat exchanger with the chemical composition of the gases unchanged from the composition as the gases passed the shield.

4. The combination of claims 2 wherein the porous material comprising the shield includes reticulated silicon carbide.

5. The combination of claim 4 wherein the porous material has an open cell configuration equal to about ten to about thirty cells per lineal inch.

6. The combination of claim 5 including a flue means for receiving the combustion gases passing through the shield and delivering said gases to a heat exchanger with the chemical composition of the gases unchanged from the composition as the gases passed the shield.

7. The combination of claim 4 including a flue means for receiving the combustion gases passing through the shield and delivering said gases to a heat exchanger with the chemical composition of the gases unchanged from the composition as the gases passed the shield.

8. The combination of claim 1 including a flue means for receiving the combustion gases passing through the shield and delivering said gases to a heat exchanger with the chemical composition of the gases unchanged from the composition as the gases passed the shield.

9. A method of decreasing heat loss from a furnace and increasing the useful life of mechanical components in direct contact with combustion products exiting said furnace, said furnace including an enclosure, an inlet to said enclosure for supplying fuel and oxygen, a burner operatively associated with said inlet for promoting fuel combustion and creating heat and combustion products, and an outlet from said enclosure for the exit of said combustion products, forming a heat radiation shield of porous silicon carbide, shaping the periphery of the shield to fill the outlet to the extent that mechanical components outside the furnace which are directly contacted by said combustion products do not receive direct heat radiation from inside the furnace, mounting the shield in the outlet and burning fuel and passing combustion products from the burned fuel through the shield without changing the chemical properties of the combustion products except to reduce the nitrous oxide content.

10. The method of claim 9 including delivering the combustion products passing the shield to a heat exchanger with the chemical composition of the combustion products unchanged from the time they passed the shield and extracting heat from the combustion products.

11. The method of claim 9 including structuring the pore size and thickness of said shield to provide for a pressure drop of about 0.07 in. (to 0.18 cm.) of water at a steady state furnace operation at a temperature of about 2300° F.

12. The method of claim 11 including delivering the combustion products passing the shield to a heat exchanger with the chemical composition of the combustion products unchanged from the time they passed the shield and extracting heat from the combustion products.

* * * * *